United States Patent [19]

Calini

[11] 4,024,688

[45] May 24, 1977

[54] CONCRETE REINFORCING BAR EXTENSION CONSTRUCTION AND METHOD

[76] Inventor: Anthony J. Calini, Rte. No. 1, Guilford, Conn. 06437

[22] Filed: Mar. 5, 1976

[21] Appl. No.: 664,107

Related U.S. Application Data

[63] Continuation of Ser. No. 171,089, Aug. 12, 1971, abandoned.

[52] U.S. Cl. ..... 52/378; 52/722; 52/726; 52/741; 403/310; 403/312

[51] Int. Cl.[2] ..... E04B 1/16

[58] Field of Search ..... 403/310, 311, 312, 314; 52/726, 223, 583, 584, 378, 722, 741

[56] References Cited

UNITED STATES PATENTS

| | | | |
|---|---|---|---|
| 760,621 | 5/1904 | Guy | 403/312 |
| 1,281,284 | 10/1918 | Brunson | 403/314 |
| 1,406,229 | 2/1922 | Schneider | 403/312 |
| 2,060,548 | 11/1936 | Bolling | 403/300 |
| 2,067,271 | 1/1937 | Johnson et al. | 403/310 |
| 2,303,031 | 11/1942 | Dusevoir | 403/364 |
| 2,326,941 | 8/1943 | Heitner | 403/286 |
| 2,845,701 | 8/1958 | Daigle | 403/338 X |
| 2,920,475 | 1/1960 | Graham | 52/432 |
| 3,245,190 | 4/1966 | Reiland | 52/722 X |
| 3,253,332 | 5/1966 | Howlett et al. | 24/506 |
| 3,398,978 | 8/1968 | Gasche | 285/367 |
| 3,562,978 | 2/1971 | Ali-Oglu | 52/583 |

FOREIGN PATENTS OR APPLICATIONS

| | | | |
|---|---|---|---|
| 553,019 | 2/1923 | France | 403/310 |

*Primary Examiner*—Alfred G. Perham
*Attorney, Agent, or Firm*—DeLio and Montgomery

[57] ABSTRACT

This specification discloses a method and construction for joining the ends of concrete reinforcing bars which permits the development of both tension and compression in the bars. A joining member compressively engages adaptor members integrally joined to the ends of the bars and reacts any forces tending to separate the bars, and further permits transmittal of compressive forces therebetween.

8 Claims, 10 Drawing Figures

INVENTOR

Anthony J. Calini

BY Dealio and Montgomery

ATTORNEYS

INVENTOR

Anthony J. Calini

BY DeLio and Montgomery

ATTORNEYS

CONCRETE REINFORCING BAR EXTENSION CONSTRUCTION AND METHOD

This is a continuation of application Ser. No. 171,089, filed Aug. 12, 1971 now abondoned.

This invention relates to reinforced concrete construction and more particularly relates to extension of reinforcing bars used in concrete construction.

In the construction industry many buildings, bridges, and other structures are basically formed of concrete reinforced with steel bars commonly referred to as rebars. In the pouring of columns it is common practice to build forms of predetermined height, insert rebars therein in tied assemblies and then pour the concrete into the form. As the column proceeds upwardly, the form is extended and additional bars used which may overlap the ends of the previously used bars, or may be connected thereto as by welding. Such welding to achieve the desired splicing is quite time-consuming and as a result very expensive. The chemistry of the steel must be proper and in many cases requires X-raying to check for voids in the weld. Where the rebars are overlapped, some of the length of the bars is lost as they are overlapped for developing continuity between concrete pours.

Additionally, in some instances, a sleeve-like device has been utilized to join adjoining bars in compression along a portion of their adjacent edges. In this technique, the rebars are extended through a sleeve-like member which compressively engages the outer periphery thereof for joining purposes. However, this does not permit development of tension at the joint between the rebars.

Still another known technique of joining rebars is to provide an assembly which includes a sleeve around the abutting ends and set off a charge of an incendiary which fuses the ends of the rebar together as well as to the sleeve. Such joints are quite expensive, and do not find the widespread use as the mere overlapping.

Accordingly, the present invention provides a method and apparatus for extending rebars which is capable of developing the full strength of various size rebars in tension as well as in compression. This invention produces a rebar splice in one plane that fully develops rebars in tension and compression at joints in a structure which have always been a vulnerable point from the standpoint of structrual strength.

An object of this invention is to provide a new and improved construction and method for extending concrete reinforcing bars.

Another object of this invention is to provide a new and improved method of joining the ends of concrete reinforcing bars to provide extensions thereof between different concrete pours.

A further object of this invention is to provide a new and improved construction and method for the purposes described which is low in cost of materials and parts, and which permits rapid joining and extension of reinforcing bars.

Briefly stated, the invention in one form thereof comprises the use of adaptor members having a first end welded to the adjacent ends of first and second rebars and a second end of larger diameter. The smaller ends of the adaptors are electrically welded to the ends of the rebars. The adaptors are then compressively engaged by a two-part clamping member which reacts through the larger diameter portion to develop tension at the joint and act against forces tending to separate the rebars.

The features of the invention which are believed to be novel are particularly pointed out and distinctly claimed in the concluding portion of this specification. The invention, however, both as to its organization, operation and method of application together with further objects and advantages thereof may best be appreciated by reference to the following detailed description taken in conjunction with the drawings wherein:

Figure 1:
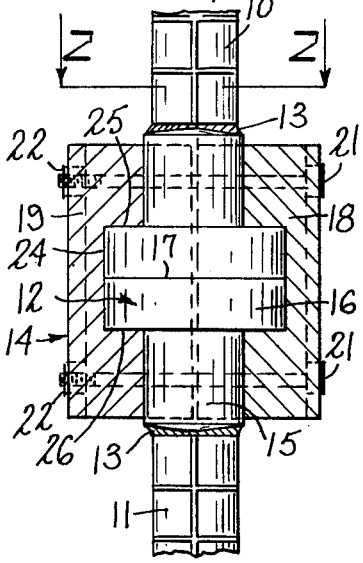
FIG. 1 is a view of two concrete reinforcing bars joined in accordance with the invention and showing a joining means in half section.

In FIG. 1, two concrete reinforcing bars (rebars) 10 and 11 are joined and extended by means of adaptor members 12 integrally joined to adjacent ends of the rebars 10 and 11 as by welding as indicated by the reference numeral 13, and then held together by a joining or clamping member 14 generally in the form of a split collar or sleeve. Each of the members 12 comprises a shank portion 15 of a diameter equal to or slightly larger than the rebars and a second or head portion 16 of larger diameter terminating in a generally planar surface 17.

The members 12 are preferably welded to the ends of the rebars by an arc or capacitor discharge stud welding proces. In the stud welding process, the end of the shank 15 is positioned in close proximity to the end of the rebar, a welding arc is struck and puddles the end of the shank. When the puddling occurs, the adjacent ends of the shank and the rebar become molten and the molten end of the shank is merged into the molten area of the rebar and a complete integral bonding of the metal of the member 12 and the rebar occurs.

Figure 2:
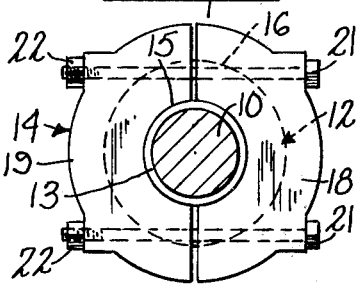
FIG. 2 is a view seen in the plane of lines 2—2 of FIG. 1.

With the members 12 placed on the rebars, the surfaces 17 thereof are abutted and sleeve-like member 14 comprising half portions 18 and 19, as shown in FIG. 2, are positioned around the periphery of shank portions 15 and then tightened thereabout as by means of bolts 21 passing there-through and receiving nuts 22 thereon. The half parts 18 and 19 of the joining member 14 define an internal cylindrical cavity 24 having upper and lower shoulders 25 and 26, respectively, which hold the head portions 16 from separation, while compressively engaging the shank portions 15. It will be noted that the cavity defining walls of members 18 and 19 do not subtend a full 180 degrees each but are slightly smaller so that when joined a holding force will be exerted on the peripheries of shank portions 15.

With this construction and technique of joining, any tensional forces exerted on the rebars will be reacted through the shoulders 25 and 26 of members 18 and 19 and react against any tendency for the rebars to separate. At the same time, the sleeve 14 and abutting surfaces 17 transfer any compressive forces on the rebars from along the lengths thereof.

In the manner described, the rebars may be continuously extended and positively joined through various concrete pours as hereinafter will be more particularly pointed out.

Figure 3:
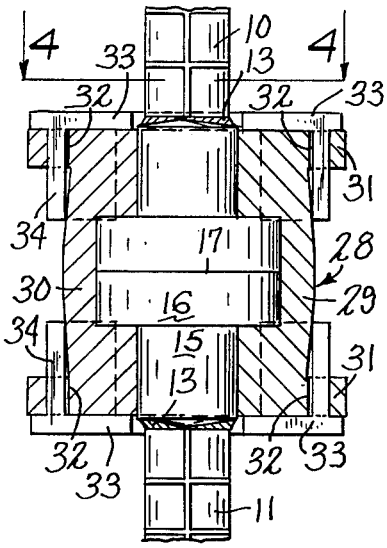
FIG. 3 is a view similar to FIG. 1 but showing a different embodiment of a joining means.
Figure 4:
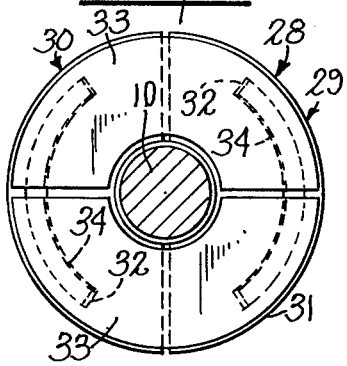
FIG. 4 is a view seen in the plane of lines 4—4 of FIG. 3.

FIGS. 3 and 4 exemplify another joining member 28 which comprises half sleeve or collar members 29 and 30 defining an internal cylindrical cavity and having outer sidewalls which are tapered otwardly from the ends thereof toward the center, and flanges 31. The flanges 31 are provided with arcuate slots 32 therein extending axially thereof. Locking members 33 having depending arcuate portions 34 are driven into the arcuate slots 32 of each of members 29 and 30 to compressively clamp the members 29 and 30 together. The portions 34 upon engaging the tapered sidewalls move the members 29 and 30 together to compressively engage the shank portion 15.

In construction, the surfaces 17 are again abutted. The members 29 and 30 are placed about the members 12 and then two of the locking members 33 are joined to the members 29 and 30 at each end thereof.

Figure 5:
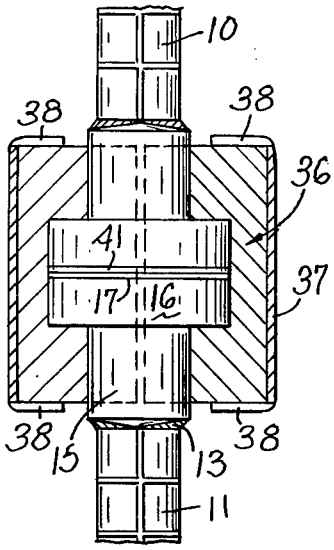
FIG. 5 is a view similar to FIG. 1 but showing still another joining member.
Figure 6:
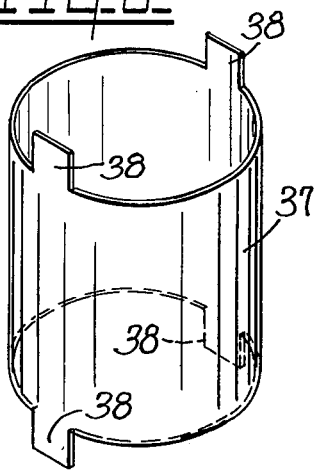
FIG. 6 is a view in perspective of a sleeve which forms a portion of a joining member of FIG. 5.

Another joining member is shown in FIGS. 5 and 6 and generally comprises a two-part joining member 36 similar to that shown in FIG. 1 but which is held together by means of an outer sleeve 37 having tangs or lugs 38 thereon. In construction, the members 12 are joined to the ends of the rebars 10 and 11 as previously described. Prior to the members 12 being abutted, the sleeve 37 is placed over one member. Then the two-part sleeve or collar 36 is positioned about the members 12. The sleeve 37 is then slipped thereover and the lugs 38 then over to securely clamp the members together.

As shown in FIG. 5, because of manufacturing tolerances, the head portions 16 of the members 12 may be made slightly undersized, then shims 41 of gauge dimensions may be placed therebetween as the rebars are joined for extension thereof.

Figure 7:
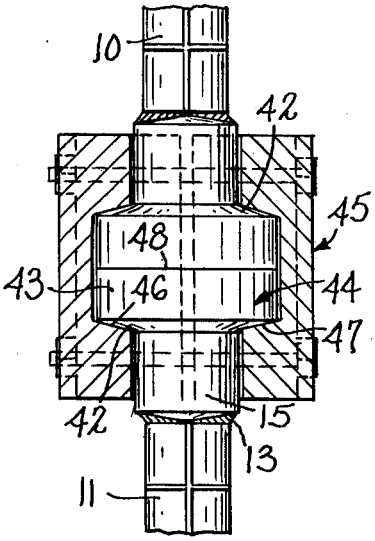
FIG. 7 is a view similar to FIG. 1 but showing an alternate embodiment of the invention.

In still another embodiment of the invention, as shown in FIG. 7, the joining members may be formed with a tapered peripheral portion between the small end and large end. As shown, the undersurface 42 of the head 43 of adaptor member 44 is tapered or frustoconical in shape. As the halves of joining member 45 are clamped about adaptors 44, the tapered shoulders 46 and 47 thereof engage the matingly tapered undersides 42 and urge the surfaces 48 of the adaptors into engagement. The degree and area of taper of the periphery of the adaptor and the shoulders of the joining member are chosen for the resolution of forces desired.

Figure 8:
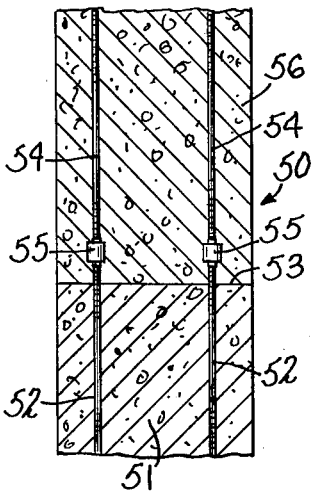
FIG. 8 is a view partially cut away of a vertical concrete column utilizing reinforcing bars joined in accordance with the invention.

FIG. 8 exemplifies a vertical column 50 in which rebar extensions incorporating the invention are utilized. A lower or first concrete pour 51 is provided with rebars 52 extending vertically therein and past the line of pour 53. The ends of the rebars 52 as well as the lower ends of rebars 54 are constructed in one of the manners previously described to effect the extension joints 55 above the first concrete pour 51. Thereafter, the forms are constructed to enclose the second concrete pour 56 and the pour is made.

With this construction, it will be seen that the rebars 52 are extended into the rebars 54 and joined to develop both compression and tension. If there is any tendency of the column 50 to sway or move horizontally, the clamping members will hold the members 12 together to develop the tension in the rebars. Also, the abutting surfaces of the adaptors 12 transfer compressive forces between the rebars. Such compression may also be transmitted through the joining members, which maintain the rebars in coaxial alignment.

Figure 9:
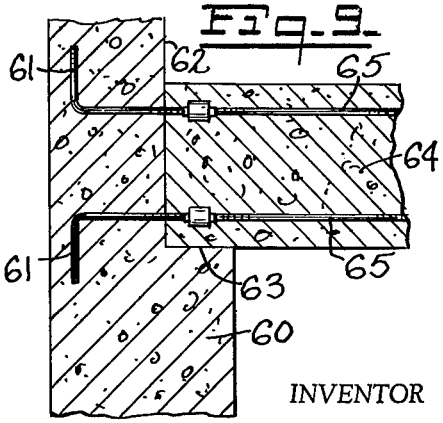
FIG. 9 is a view of a concrete column partially supporting a horizontal beam where the reinforcing bars are joined in accordance with the invention.

FIG. 9 exeplifies a vertical column or wall 60 having rebars 61 initially cast therein and extending through surface 62. The wall or column 60 is further provided with a ledge 63 adapted to receive the end of a horizontal deck or beam 64.

With the column or wall 60 in place and prior to pouring the deck or beam 64, rebars 65 are extended from rebars 61 in one of the manners previously described. Then, the form for the deck or beam 64 is erected and the deck or beam poured. This results in a continuous extension of the rebars 61 into the rebars 65. It will be further noted that any deflection of the beam or deck 64 which may take place due to loading thereof will develop tension of both the rebars 61 and 65 through the joint extensions thereof.

Figure 10:
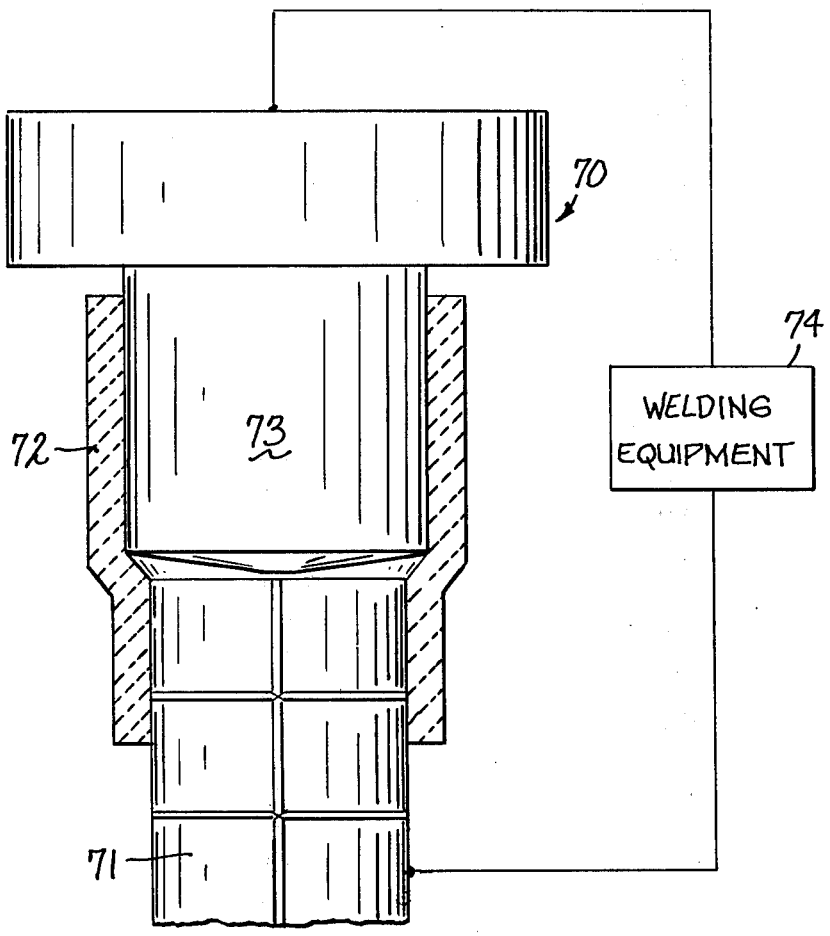
FIG. 10 is a drawing partially in longitudinal half section exemplifying the manner in which an adaptor member is joined to the end of a reinforcing rod.

FIG. 10 exemplifies the technique of welding an adaptor member 70 to the end of a rebar 71. A destructible insulating sleeve 72 is positioned about shank 73 and a portion of rebar 71. The adaptor 70 and sleeve 72 may be positioned in a gun-like device (not shown). When the welding current is applied from welding equipment generally indicated by the reference numeral 74, an arc is created between the end of adaptor 70 and the end of rebar 71. The arc will puddle the metal at the end of the adaptor and the end of the rebar. As the puddling occurs, the current increases and renders both ends molten. Then the molten end of the adaptor is pushed into the molten end of the rebar and complete and homogeneous fusion occurs across the diameter of the rebar. The gun or other device holding the adaptor may include an electrode which contacts the rebar to complete an electric circuit for welding purposes. The insulating sleeve may then be broken and removed.

It may thus be seen that the objects of the invention set forth as well as those made apparent from the foregoing description are efficiently attained. While preferred embodiments of the invention have been set forth for purposes of disclosure, modification to the disclosed embodiments of the invention as well as other embodiments thereof may occur to those skilled in the art. Accordingly, the appended claims are intended to cover all embodiments of the invention and modifications to the disclosed embodiments which do not depart from th spirit and scope of the invention.

What is claimed is:

1. In combination with a concrete structure cast on site and having first and second contacting concrete sections poured on site at different times, a first rigid reinforcing bar extending in the structure from the first poured section to the other and a second rigid reinforcing bar in the other section and connected to said first bar, an improved joint between said first and second bars comprising an adaptor member rigidly joined to adjacent ends of each of said bars, each of said adaptor members comprising a first end portion of a first diameter connected to the adjacent ends of each of the bars and a second end portion of larger diameter and having a planar end surface, a peripheral surface between said different diameter portions defining a shoulder, a clamping member disposed about said adaptors and engaging said shoulders of said adaptors and rigidly holding said end surfaces in contact whereby the joint between said reinforcing rods reacts all compression and tension forces exerted on said rods.

2. The structure of claim 1 wherein said clamping member has an internal wall defining a cylindrical cavity, said clamping member cavity provides end surfaces which react against said adaptor shoulders to compressively engage said end surfaces of said adaptors.

3. The construction of claim 1 wherein said adaptors have a tapered peripheral surface between the end portions thereof and said clamping member has internal tapered surfaces adapted to matingly engage the tapered peripheral surfaces of said adaptors.

4. The construction of claim 1 wherein said clamping member comprises mating half sections, and means for compressively joining said half sections about said adaptors.

5. The construction of claim 1 wherein said adaptors have a generally T-shaped in longitudinal half section.

6. The construction of claim 1 wherein at least one rigid shim is disposed between said end surfaces and in surface engagement with said end surfaces.

7. A method of making a reinforced concrete structure comprising abutting sections of concrete poured at different times on site comprising the steps of providing two concrete reinforcing bars, rigidly connecting joining adaptors to at least one end of each bar, said adaptors having a first portion of a first diameter connected to the ends of the bar and a second portion of a larger diameter and having a planar end surface, and a peripheral surface extending between said different diameter portions, pouring one section of concrete with one bar embedded therein with the adaptor end extending therefrom, abutting said end surfaces of said adaptors, applying a joining member about said abutting adaptors which engages said peripheral surfaces of said adaptors and holds said surfaces in contact to connect the second bar to the first and pouring the second section of concrete about said second bar.

8. The method of claim 7 wherein the step of connecting includes positioning said first end portion of an adaptor with respect to an end of a bar and passing an electric current axially through said ends to fuse said ends together.

* * * * *

UNITED STATES PATENT AND TRADEMARK OFFICE

CERTIFICATE OF CORRECTION

PATENT NO. : 4,024,688

DATED : May 24, 1977

INVENTOR(S) : Anthony J. Calini

It is certified that error appears in the above-identified patent and that said Letters Patent are hereby corrected as shown below:

Column 2, line 49, "proces" should read --process--.

Column 3, line 18, "otwardly" should read --outwardly--.

Column 5, line 2 of claim 5, "shaped" should read --shape--.

Signed and Sealed this

*second* Day of *August 1977*

[SEAL]

*Attest:*

RUTH C. MASON
*Attesting Officer*

C. MARSHALL DANN
*Commissioner of Patents and Trademarks*